US007367468B2

(12) United States Patent
Lai

(10) Patent No.: US 7,367,468 B2
(45) Date of Patent: May 6, 2008

(54) VANITY CASE HAVING SOLID LATCH DEVICE

(75) Inventor: Chin Chun Lai, Hsinchu (TW)

(73) Assignee: Chao Ling Chemical Industry Co., Ltd., Hsinchu (TW)

( * ) Notice: Subject to any disclaimer, the term of this patent is extended or adjusted under 35 U.S.C. 154(b) by 675 days.

(21) Appl. No.: 11/028,436

(22) Filed: Dec. 30, 2004

(65) Prior Publication Data

US 2006/0237342 A1 Oct. 26, 2006

(51) Int. Cl.
*B65D 25/04* (2006.01)

(52) U.S. Cl. ..... 220/507; 206/581

(58) Field of Classification Search ..... None
See application file for complete search history.

(56) References Cited

U.S. PATENT DOCUMENTS

| | | | | |
|---|---|---|---|---|
| 1,774,543 | A | 9/1930 | Babbitt | |
| 2,468,161 | A | 4/1949 | Beseke | |
| 4,826,014 | A * | 5/1989 | Schefer | 206/581 |
| D360,487 | S | 7/1995 | Ko | D28/78 |
| D407,856 | S | 4/1999 | Orsomando | D28/83 |
| D428,211 | S | 7/2000 | Gavin | D28/83 |
| D443,393 | S | 6/2001 | Goswell | D28/83 |
| 6,283,129 | B1 * | 9/2001 | Yuhara et al. | 132/295 |
| 6,932,220 | B2 * | 8/2005 | Byun | 206/581 |
| 6,978,790 | B2 * | 12/2005 | Byun | 132/287 |
| 2004/0089668 | A1 * | 5/2004 | Lambelet | 220/835 |

* cited by examiner

*Primary Examiner*—Stephen J. Castellano
(74) *Attorney, Agent, or Firm*—Charles E. Baxley

(57) ABSTRACT

A vanity case includes a lower casing, an upper cover rotatably attached to a rear portion of the lower casing, and includes a lock projection. A latch device is rotatably attached to a front portion of the lower casing, to selectively lock the upper cover relative to the lower casing. The latch device includes a lock opening for engaging with the lock projection of the upper cover, and to solidly secure and lock the upper cover to the lower casing. The upper cover includes a lock recess to engage with the latch device when the latch device is rotated relative to the lower casing to the folded locking position, and to prevent the upper cover from being moved laterally relative to the lower casing.

2 Claims, 3 Drawing Sheets

VANITY CASE HAVING SOLID LATCH DEVICE

BACKGROUND OF THE INVENTION

1. Field of the Invention

The present invention relates to a vanity case or compact or cosmetic casing, and more particularly to a vanity case or compact or cosmetic casing having a solid latch device to solidly secure or lock the vanity case in place, and to prevent the vanity case from being opened inadvertently.

2. Description of the Prior Art

Various kinds of typical compacts, vanity cases, cosmetic casings, or the like have been developed and widely used for a long time, and all comprise a lower casing body, and an upper cover member pivotally attached to the lower casing body, to allow the upper cover member to be opened and closed relative to the lower casing body.

For example, U.S. Des. 360,487 to Ko, U.S. Des. 407,856 to Orsomando, U.S. Des. 428,211 to Gavin, U.S. Des. 443,393 to Goswell, U.S. Pat. No. 1,774,543 to Babbitt, and U.S. Pat. No. 2,468,161 to Beseke, disclose several of the typical compacts, vanity cases, cosmetic casings, or the like, and each includes a catch device to openably catch or lock the upper cover member to the lower casing body.

However, the catch devices of the typical compacts, vanity cases, cosmetic casings, or the like are engaged or coupled with each other by frictional forces or by force-fitted engagements, and may not be solidly engaged with each other, such that the upper cover member and the lower casing body may have a good chance to be opened inadvertently.

The present invention has arisen to mitigate and/or obviate the afore-described disadvantages of the conventional vanity cases or compacts or cosmetic casings.

SUMMARY OF THE INVENTION

The primary objective of the present invention is to provide a vanity case or compact or cosmetic casing including a solid latch device to solidly secure or lock the vanity case in place, and to prevent the vanity case from being opened inadvertently.

In accordance with one aspect of the invention, there is provided a vanity case comprising a lower casing including a number of compartments formed therein, for receiving various materials therein, and including a notch formed in a rear portion thereof and defined between two opposite walls, and including a depression formed in a front portion thereof and defined between two opposite fences, and including an orifice formed in each of the walls and the fences, an upper cover including at least one protrusion extended from a rear portion thereof, for engaging into the notch of the lower casing, and including a pivot axle extended from the protrusion and rotatably engaged into the orifices of the walls of the lower casing, to rotatably attach the upper cover to the lower casing, and to allow the upper cover to be rotated relative to the lower casing between an outwardly opened working position and a folded storing position, the upper cover including a lock projection extended upwardly from an upper surface thereof, and a latch device including at least one block extended from a first end thereof, for engaging into the depression of the lower casing, and including a pivot pin extended from the block, and rotatably engaged into the orifices of the fences of the lower casing, to rotatably attach the latch device to the lower casing, and to allow the latch device to be rotated relative to the lower casing between an outwardly opened position and a folded locking position, for locking and unlocking the upper cover relative to the lower casing. The latch device includes a lock opening formed in a second end thereof for engaging with the lock projection of the upper cover, and to solidly secure and lock the upper cover to the lower casing, and to prevent the upper cover from being opened relative to the lower casing inadvertently.

The upper cover includes a lock recess formed in the front portion thereof, for receiving and engaging with the latch device when the latch device is rotated relative to the lower casing to the folded locking position, and to prevent the upper cover from being moved laterally relative to the lower casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
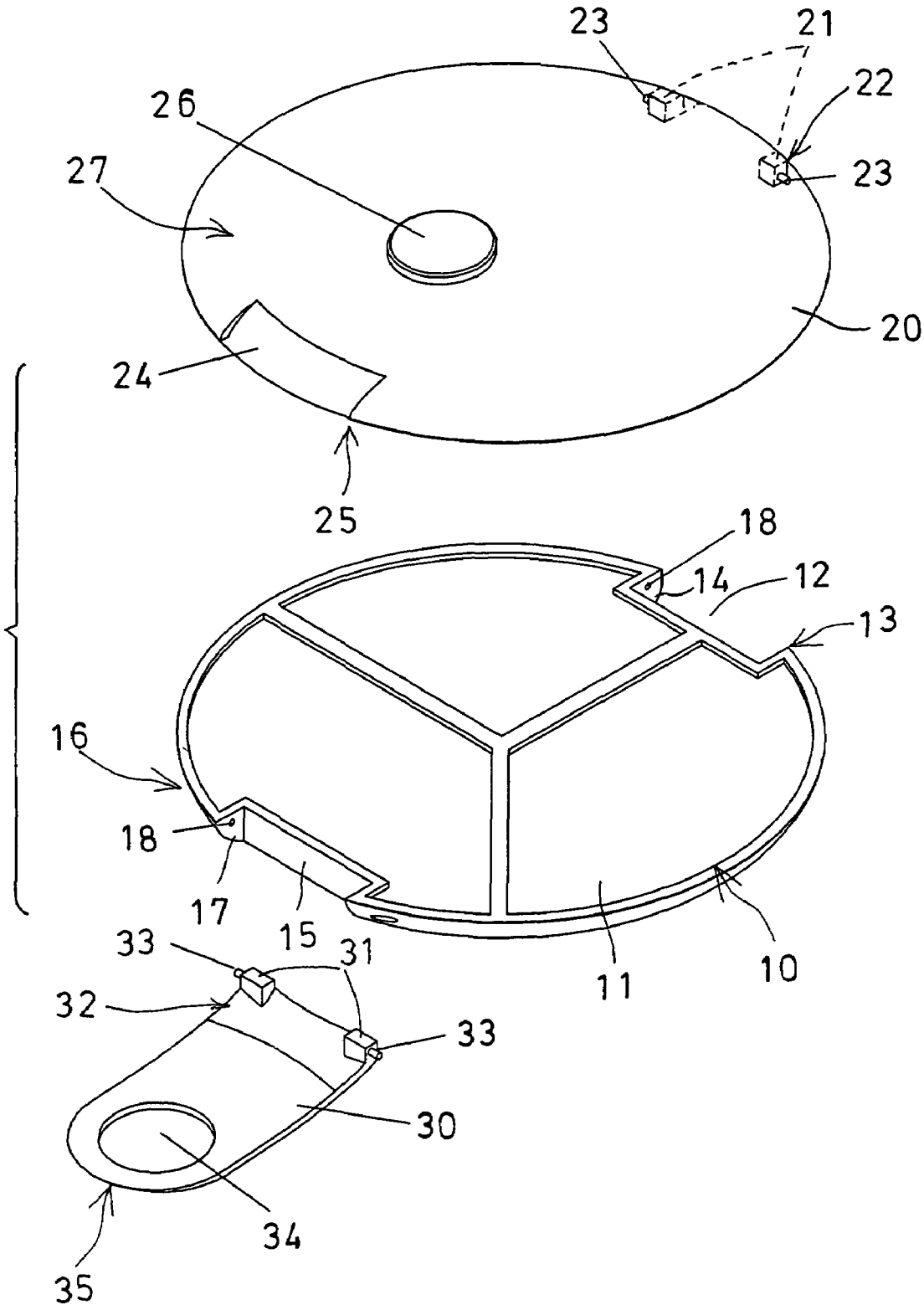
FIG. 1 is an exploded view of a vanity case in accordance with the present invention.
Figure 2:
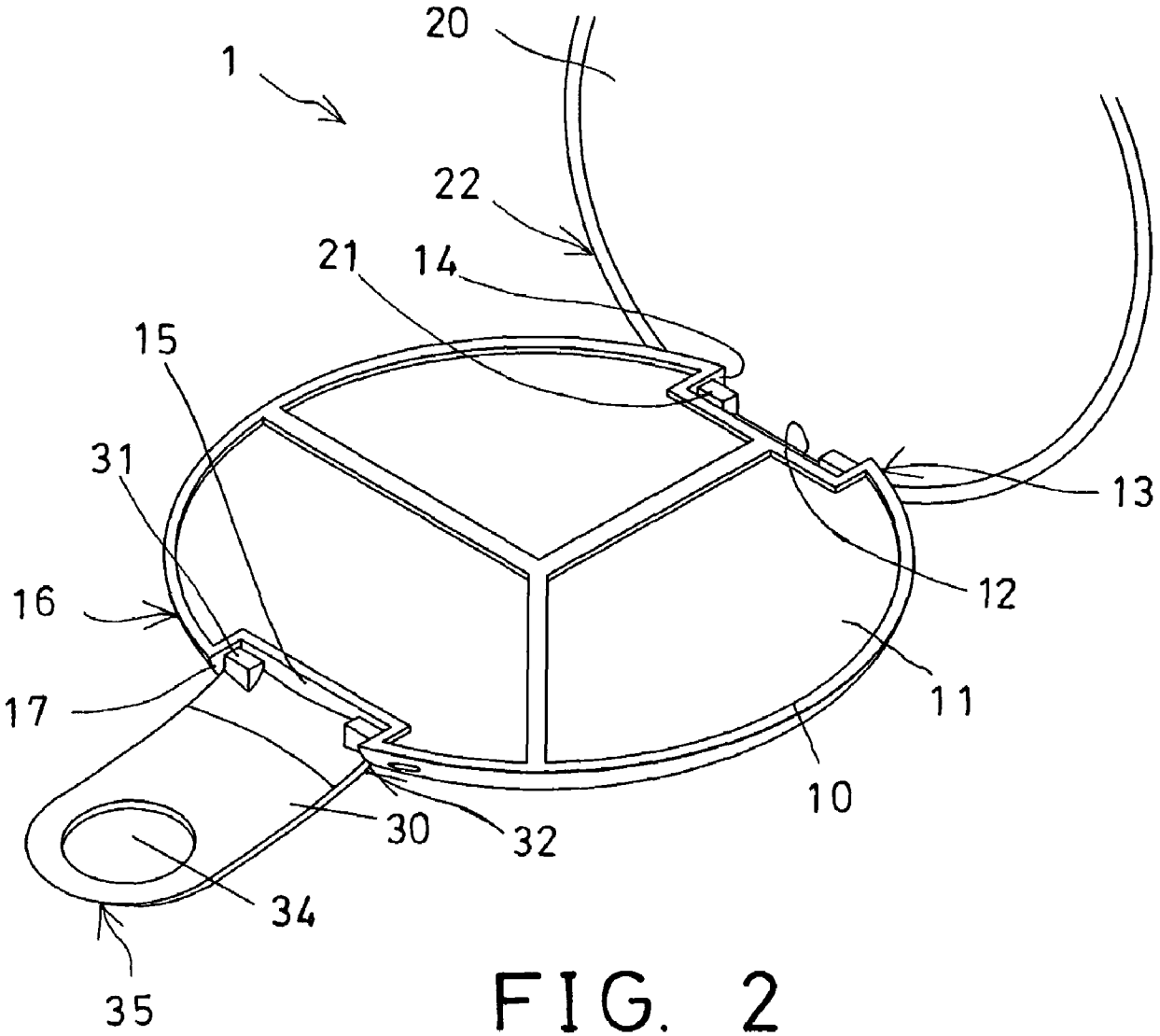
FIG. 2 is a perspective view of the vanity case, in which the vanity case is arranged in an open or working position.

Referring to the drawings, and initially to FIGS. 1 and 2, a compact or cosmetic casing or vanity case 1 in accordance with the present invention comprises a lower casing 10 including a number of spaces or compartments 11 formed therein, for receiving various cosmetic materials therein, and including a notch 12 formed in one end or rear portion 13 thereof and defined between two opposite walls 14.

It is preferable that the lower casing 10 further includes a depression 15 formed in the other end or front portion 16 thereof and defined between two opposite fences 17, and an orifice 18 formed in each of the walls 14 and the fences 17, for pivotally attaching an upper cover 20 and a latch device 30 to the lower casing 10.

For example, the upper cover 20 includes one or more, such as two protrusions 21 formed or extended from one end or rear portion 22 thereof, for engaging into the notch 12 that is formed in the rear portion 13 of the lower casing 10, and includes a pivot axle 23 extended from each of the protrusions 21, and rotatably or pivotally engaged into the corresponding orifices 18 of the lower casing 10, to rotatably or pivotally attach the upper cover 20 to the lower casing 10.

Figure 3:
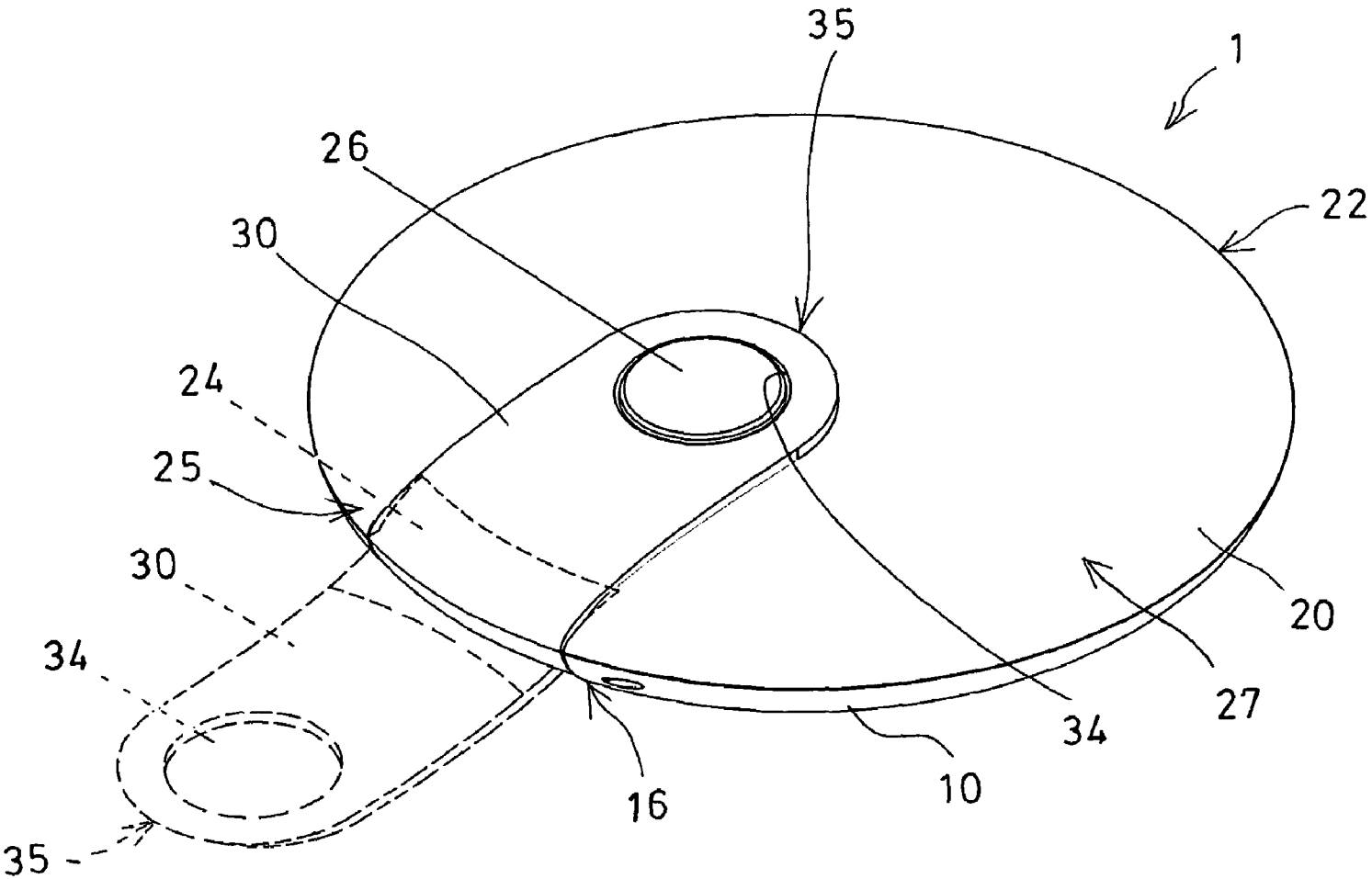
FIG. 3 is a perspective view of the vanity case, in which the vanity case is arranged in a folded or storing position having a latch device shown in both locked and unlocked positions, illustrating the operation of the vanity case.

The upper cover 20 may thus be rotated relative to the lower casing 10 between an upwardly or outwardly opened or working position (FIG. 2) and a folded or storing position (FIG. 3). In addition, the upper cover 20 may be engaged with the lower casing 10 (FIG. 2), to limit the upper cover 20 to rotate relative to the lower casing 10, and to maintain the upper cover 20 relative to the lower casing 10 at the opened or working position. The above-identified structure of the vanity case 1 is typical and will not be described in further details.

The upper cover 20 further includes a lock recess 24 formed in the other end or front portion 25 thereof, and further includes a lock projection 26 formed or extended upwardly from an upper surface 27 thereof, and preferably aligned with the lock recess 24 thereof, and/or preferably located close to the lock recess 24 or the front portion 25 thereof.

The latch device 30 includes one or more, such as two blocks 31 formed or extended from one end 32 thereof, for engaging into the depression 15 that is formed in the front portion 16 of the lower casing 10, and includes a pivot pin 33 extended from each of the blocks 31, and rotatably or pivotally engaged into the corresponding orifices 18 of the lower casing 10, to rotatably or pivotally attach the latch device 30 to the lower casing 10.

The latch device 30 may thus be rotated relative to the lower casing 10 between an outwardly opened or working position, as shown in solid lines in FIG. 2 and as shown in dotted lines in FIG. 3, and a folded or locking position as shown in solid lines in FIG. 3, for locking and unlocking the upper cover 20 relative to the lower casing 10.

The latch device 30 further includes a lock opening 34 formed in the other end 35 thereof for receiving or for engaging with the lock projection 26 of the upper cover 20, best shown in solid lines in FIG. 3, in order to solidly secure and lock the upper cover 20 to the lower casing 10, and thus to prevent the upper cover 20 from being opened relative to the lower casing 10 inadvertently.

As also shown in FIG. 3, when the latch device 30 is rotated relative to the lower casing 10 to the folded or locking position as shown in solid lines in FIG. 3, and to lock the upper cover 20 relative to the lower casing 10, the one end 32 of the latch device 30 may be engaged into the lock recess 24 of the upper cover 20, the latch device 30 may further be engaged with or anchored to the upper cover 20, to further solidly anchoring the upper cover 20, and to prevent the upper cover 20 from being moved laterally relative to the lower casing 10.

As shown in FIG. 3, when the upper cover 20 is locked to the lower casing 10, the upper cover 20 may be prevented from being opened relative to the lower casing 10 by such as children inadvertently, or when the vanity case 1 is dropped onto the ground, or the like.

Accordingly, the vanity case or compact includes a solid latch device to solidly secure or lock the vanity case in place, and to prevent the vanity case from being opened inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A vanity case comprising:

a lower casing including a plurality of compartments formed therein, for receiving various materials therein, and including a notch formed in a rear portion thereof and defined between two opposite walls, and including a depression formed in a front portion thereof and defined between two opposite fences, and including an orifice formed in each of said walls and said fences, an upper cover including at least one protrusion extended from a rear portion thereof, for engaging into said notch of said lower casing, and including a pivot axle extended from said at least one protrusion and rotatably engaged into said orifices of said walls of said lower casing, to rotatably attach said upper cover to said lower casing, and to allow said upper cover to be rotated relative to said lower casing between an outwardly opened working position and a folded storing position, said upper cover including a lock projection extended upwardly from an upper surface thereof, and a latch device including at least one block extended from a first end thereof, for engaging into said depression of said lower casing, and including a pivot pin extended from said at least one block, and rotatably engaged into said orifices of said fences of said lower casing, to rotatably attach said latch device to said lower casing, and to allow said latch device to be rotated relative to said lower casing between an outwardly opened position and a folded locking position, for locking and unlocking said upper cover relative to said lower casing, and said latch device including a lock opening formed in a second end thereof for engaging with said lock projection of said upper cover, and to solidly secure and lock said upper cover to said lower casing, and to prevent said upper cover from being opened relative to said lower casing inadvertently.

2. The vanity case as claimed in claim 1, wherein said upper cover includes a lock recess formed in said front portion thereof, for receiving and engaging with said latch device when said latch device is rotated relative to said lower casing to said folded locking position, and to prevent said upper cover from being moved laterally relative to said lower casing.

* * * * *